United States Patent [19]

Lin

[11] Patent Number: 4,792,375

[45] Date of Patent: Dec. 20, 1988

[54] STRUCTURE OF THE AUTOMATIC TAPE CUTTER/STICKER

[76] Inventor: Shuh-Chin Lin, No. 5, Alley 35, Lane 4, An Lé Road, Chungho, Taipei Hsien, Taiwan

[21] Appl. No.: 23,476

[22] Filed: Mar. 9, 1987

Related U.S. Application Data

[63] Continuation-in-part of Ser. No. 746,979, Jun. 20, 1985, abandoned.

[51] Int. Cl.[4] ..... B32B 31/00; B32B 31/18

[52] U.S. Cl. ..... 156/510; 156/523; 156/530; 156/574; 225/16; 242/68; 242/68.3

[58] Field of Search ..... 225/16, 47; 156/523, 156/527, 530, 574, 577, 510; 242/68.3, 68

[56] References Cited

U.S. PATENT DOCUMENTS

| | | | |
|---|---|---|---|
| 3,083,927 | 4/1963 | Prosin | 242/68.3 |
| 4,253,905 | 3/1981 | Regan | 156/523 |
| 4,344,813 | 8/1982 | Holoff et al. | 156/577 X |

FOREIGN PATENT DOCUMENTS

| | | | |
|---|---|---|---|
| 2043591 | 10/1980 | United Kingdom | 156/523 |

*Primary Examiner*—David Simmons
*Assistant Examiner*—Jeff H. Aftergut
*Attorney, Agent, or Firm*—Ostrolenk, Faber, Gerb & Soffen

[57] ABSTRACT

An improved automatic tape cutter/sticker is disclosed. A first shell body has disposed thereon a compressible tube having a roll of tape disposed thereon so as to prohibit free wheeling of the tape. The first shell body is disposed within a second shell body having disposed therebetween a rotary cutting knife. Upon movement of the first shell body with respect to the second shell body, a rotary cutting knife is moved out of alignment so that the tape may be payed out. Upon removal of force from the first shell body, the rotary cutting knife rotates in the opposite direction thereby cutting the tape. Slots are provided in the first shell body to enable it to be quickly urged downwards while also allowing for closer presentation of the tape to an outlet slot in the second shell body.

4 Claims, 3 Drawing Sheets

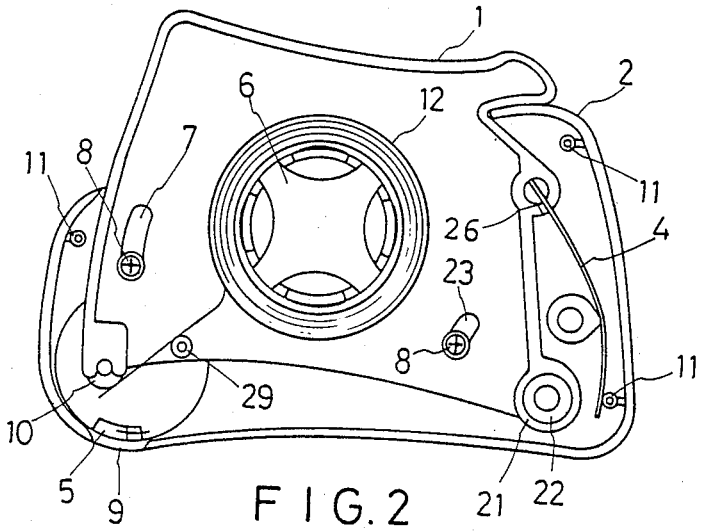
FIG. 2
FIG. 3
PRIOR ART
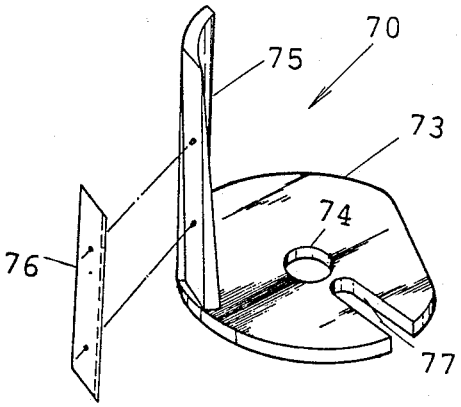
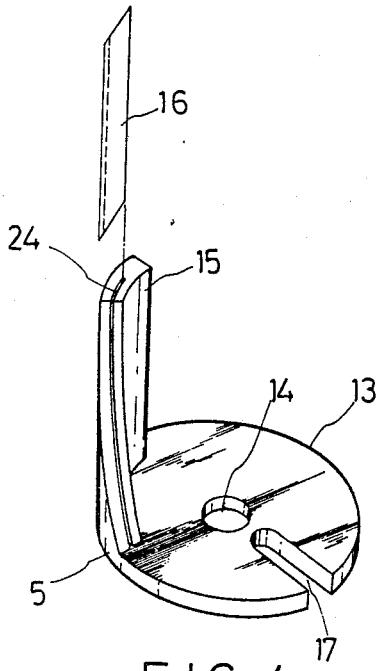
FIG. 4

STRUCTURE OF THE AUTOMATIC TAPE CUTTER/STICKER

CROSS REFERENCE TO RELATED APPLICATION

This is a continuation-in-part of Ser. No. 746,979, filed June 20, 1985, now abandoned.

BACKGROUND OF THE INVENTION

This invention relates to an automatic tape cutter and more particularly to a tape cutter/sticker having a brake device.

There are a variety of tape cutter/stickers presently utilized. Many of these devices do not impart the result that an excessive amount of tape may exit the dispenser. An example of this may be found in FIG. 5. To overcome this, some devices utilize a brake type action which is comprised of two pieces of "brake linings" having a spring disposed therebetween. An example of this may be seen in FIG. 6. However, this type of brake requires additional components and assembly which therefore increases manufacturing and assembly costs that adversely affect profitability.

Many device also incorporate a rotary type cutting knife having a non-replaceable blade. The blade is generally molded into the rotary cutting mechanism or is part of the plastic rotary cutting device itself. This may lead to premature obsolescense of the tape cutter resulting in the entire tape device having to be replaced more frequently than is necessary. An example of this may be seen in FIGS. 3, 5 and 6.

SUMMARY OF THE INVENTION

It is an object of the present invention to produce an automatic tape cutter/sticker having a brake fixing device which is inexpensive to manufacture and assemble and which does not require additional parts or components. It is also desirable to have a brake fixing device which effectively minimizes any undesired rotary motion of the tape with respect to the holder upon which it is mounted.

It is another object of the present invention to produce a tape cutter/sticker which does not require significant force while shortening the distance the tape travels before exiting from the device.

It is still a further object of the present invention to produce an automatic tape cutter/sticker having a blade which is replaceable.

It is still another object of the present invention to produce an automatic tape cutter/sticker having increased speed of the rotary cutting knife.

A further object of the present invention is to make a tighter more effective device when assembled.

It is yet another object of the present invention to produce an automatic tape cutter/sticker. The sticker includes a first shell body having a planar rear wall. There is an elongated slot in the planar rear wall and a shortened slot in the planar rear wall. A first tube is disposed perpendicular to the planar rear wall. An annular tube is perpendicularly disposed on the planar rear wall. The annular tube is comprised of at least two compressible sections for resiliently engaging a roll of tape or the like. A second shell body receives the first shell body. The second shell body has a second planar rear wall. The second planar rear wall has guides disposed perpendicular to it and in alignment with the elongated slot and the shortened slot. The second shell body further has a sleeve portion perpendicular to the second planar rear wall and in alignment with the first tube, such that the first shell body is vertically movable in the second shell body. The second shell body further has a tape outlet for permitting tape or the like contained on a roll of tape to exit therefrom. A rotary cutting knife is pivotally disposed between the first shell body and the second shell body. It has a blade holder disposed perpendicular to and extending beyond the planar rear wall. The blade holder has a cutting blade disposed therein. A spring plate biases the first shell body in an upward position with respect to the second shell body. Downward movement of the first shell body with respect to the second shell body causes the rotary cutting knife to rotate out of alignment with the tape outlet and return movement of the first shell body causes the rotary cutting knife to move into alignment with the tape outlet, whereby the blade will cut the tape.

BRIEF DESCRIPTION OF THE DRAWINGS

Reference is now made to the accompanying drawings in which:

FIG. 2 is a side view of the present invention;

FIG. 3 is a perspective view of a prior art rotary cutting device;

FIG. 4 is a perspective of a rotary cutting knife of the present invention;

Art Embodiments

Figure 1:
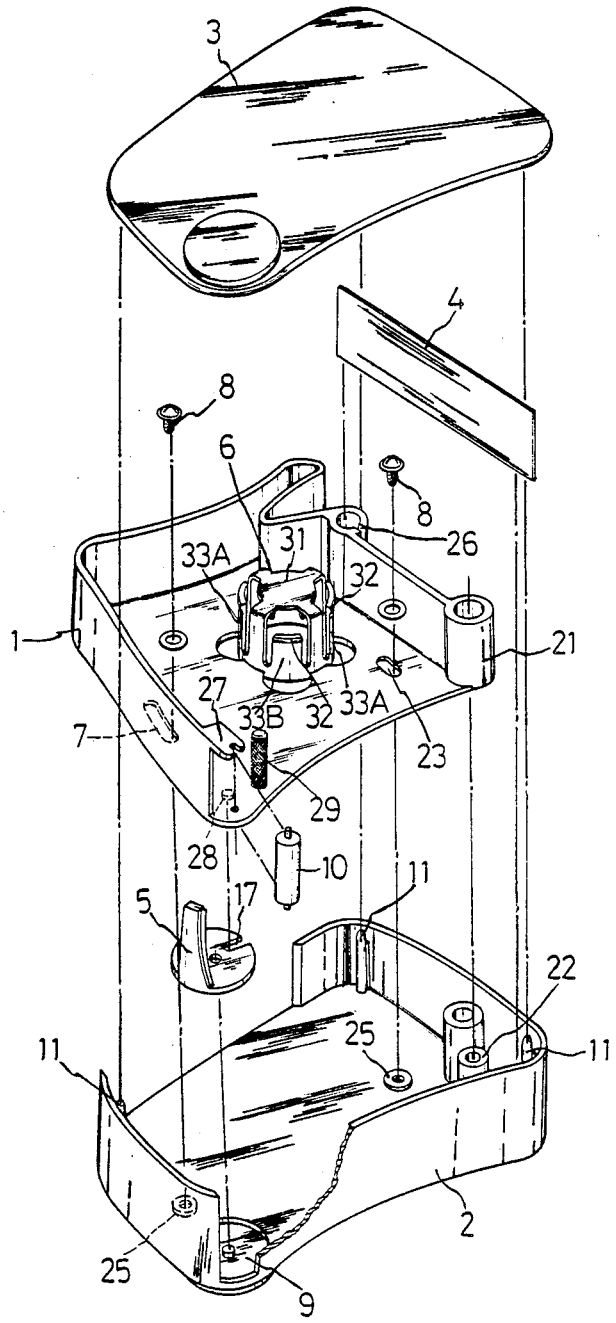
FIG. 1 is an exploded perspective view of the components of the present invention.
Figure 5:
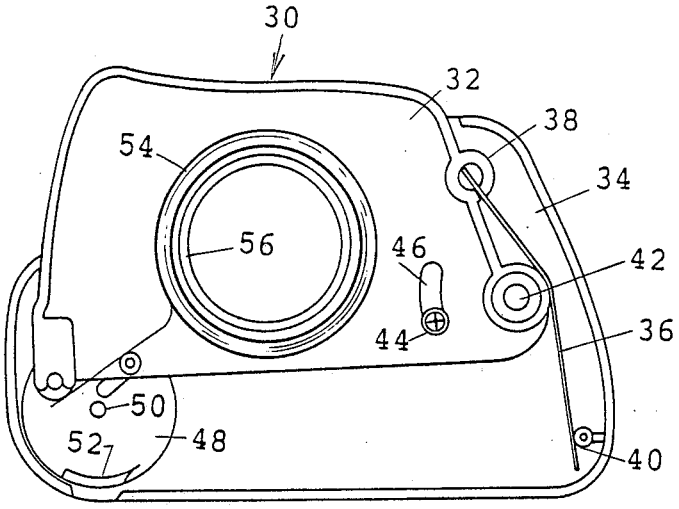
PRIOR ART FIG.5
FIGS. 5 and 6 are side views of prior art automatic tape cutters with and without a braking device, respective.

FIG. 5 shows a prior art stapler 30 including a shell body 32 which nests inside a second shell body 34. The leaf spring 36 extends between abutments 38 and 40 on the bodies 32 and 34, respectively, and bears upon the pivot region of the body 32 to pivot the body 32 clockwise around the pivot 42 to the position illustrated in FIG. 5 with the projection 44 from the shell body 34 in the end of the slot 46 in the shell body 32. A rotary knife 48 is supported at pivot 50 to rotate on the body 34. The knife 48 carries an upstanding knife 52 thereon which rotates. The tape roll 54 is supported on a support 56 on the body 32. As the body 32 is depressed down in FIG. 5, it operates the knife to cut, in a manner described with respect to the preferred embodiment. The tape is held on the support 56 by means different than those described with respect to the present invention.

Figure 6:
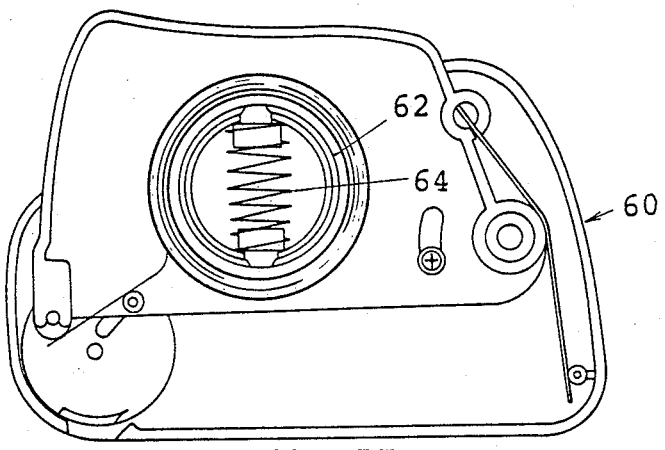
PRIOR ART FIG.6

FIG. 6 illustrates an embodiment of cutter/sticker 60 that is comparable in design to that shown in FIG. 5, except that the tape 54 is held on a support 62 which includes compression spring means 64 that are normally urged outwardly to urge the support against the interior of the tape roll. As the present invention does, this prior art reference would resist free running of the tape.

FIG. 3 illustrates a prior art embodiment of a knife 70 which includes the rotary knife holder 73 having a pivot hole 74 in it which is supported at the pivot 50 in FIG. 5. The knife holder has the notch 77 which functions as the notch 17 of the embodiment of FIG. 4. A blade holder 75 has permanently pinned or otherwise secured to it the blade 76, as can be seen in FIG. 3. The replaceability of the blade as in below described FIG. 4 is not present in the prior embodiment of FIG. 3.

DESCRIPTION OF THE PREFERRED EMBODIMENT

The present invention is generally comprised of shell body 1, bottom shell body 2 and cover plate 3. Shell body 1 nests inside shell body 2 with cover plate 3 being used to cover shell body 1 as well as for providing a finished appearance to the automatic tape cutter/-sticker. Bottom shell body 2 has a number of upstanding lugs 11 which project form the side wall of bottom shell body 2. A tape outlet notch slot 9 is provided on the lower portion of bottom shell body 2 and to allow an adhesive or the like to exit bottom shell body 2.

Inside the shell body 1, the annular tube 6 comprises four arc-shaped tube plates 33 and a central X-shaped fixing axis 31. The outer diameter of the four plates is slightly smaller than the diameter of the center hole inside roll of tape 12. There are four concave portions defined by the fixing axis 31. The left and right concave portions are provided with longer arc-shaped tube plates 33A each on each portion. These tube plates provide an outward expansion force. At the top of these tube plates, they are provided with respective outwardly extended flanges 32, which is used to fit-on standard width tape 12. Each of the upper and lower concave portions is provided with a smaller and shorter arc-shaped tube plates 33B which also provides an outward expansion force. The tops of these tube plates 33B are also provided with respective outwardly extended flanges 32, which are used to fit on narrow tape 12. Further, compressible plates 33A and 33B provide the braking function associated with the roll of tape due to the spring tension exerted by the plates. However, the tension is low enough as to allow some rotation of the tape roll around annular tube 6 when sufficient force is exerted on tape 12. Therefore, there is no "free wheeling" of tape 12 with respect to annular tube 6.

Rotary cutting knife 5 is comprised of a flat washer portion 13 having a centering hole 14 disposed therein. A blade holder 15 projects substantially perpendicularly to the washer portion 13 and has a cutting blade 16 mounted to it. The cutting blade is utilized to cut tape, or the like. Blade 16 is resiliently held in slot 24 thereby making blade 16 replaceable. In the event that cutting blade may be readily replaced simply by removing it from blade slot 24 and introducing a new cutting blade. A notch 17 extends from the outer edge of the washer portion 13 radially toward the centering hole 14. The centering hole 14 engages knob 18 contained in bottom shell body 2 which allows rotary cutting knife 5 to rotate about the knob.

Shell body 1 is mounted within bottom shell body 2 through tube 21, which is disposed on shell body 1, mating with sleeve 22 which is disposed on bottom shell body 2. Short slot 23 and elongated slot 7 disposed in shell body 1 align with respective bosses 25 contained on bottom shell body 2. Screws 8 are thereafter inserted through slots 7, 23 and into bosses 25. This allows shell body 1 to be moved within bottom shell body 2 about the pivot defined by the two sleeves 21, 22 (FIG. 2). Spring plate 4 is disposed between upstanding lug 11 and spring plate retainer 26. Spring plate 4 is bent slightly around tube 21. Spring plate 4 is used to maintain shell body 1 in an uppermost position as shown in FIG. 2.

Tape roller ramming cylinder 10 is rotatably mounted to shell body 1 between arm 27 and the planar wall of shell body 1.

Disposed on the rear side of the planar wall of shell body 1 is projection 28. This projection 28, mates with notch 17 when shell body 1 is mated to bottom 2.

Figure 7:
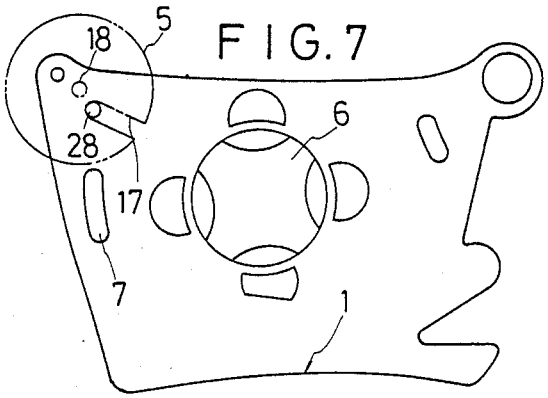
FIG. 7 is a rear view of the shell body of the present invention shown in FIG. 1.

By referring now to FIG. 2, operation of the present device may be understood. Shell body 1 is urged upwardly and maintained in its position by use of spring plate 4. When shell body 1 is urged downward by a user, the entire shell body 1 will rotate about sleeve 22 and be guided by slots 7, 23. Projection 28 which rides in notch 17 (FIG. 7), will cause rotary cutting knife 5 to rotate in a clockwise direction around knob 18, thereby causing cutting blade 16 to move out of alignment with tape outlet notch slot 9. Simultaneously, tape 12 which is disposed on annular tube 6 and which is guided by guide bar 29, will be urged downward in a somewhat arcuate path so as to present it to tape outlet notch 9 by tape roller ramming cylinder 10. Therefore, the free end of tape 12 may be either manually pulled from slot 9 or the tape may be drawn out from the automatic tape cutter/sticker by application of tape 12 to a package, or the like. Due to compressible plates 33A, 33B, only as much tape 12 as is necessary will be paid out since in the absence of exertion of force on the tape 12, only the appropriate amount of tape 12 will be allowed to be peeled off the roll.

Therefore, through use of slots 7, 23 tape 12 may be presented to slot 9 much more quickly and easily than with the prior embodiments shown in FIGS. 5 or 6. Additionally, cover plate 3 is placed as mentioned to cover bottom shell body 2. Lugs 11 are aligned with mating holes in cover plate 3 for the application of screws, glue or a snap fit as desired.

Thereafter, upon removal of force form shell body 1, the rotary cutting knife will be urged in a counterclockwise direction so as to cause cutting blade 16 to cut the tape 12 at tape outlet slot 9.

Although the present invention has been described in connection with a preferred embodiment thereof, many other variations and modifications will now become apparent to those skilled in the art. It is preferred, therefore, that the present invention is limited not by the specific disclosure herein, but only by the appended claims.

What is claimed is:

1. An automatic tape cutter/sticker comprising a main shell body, a bottom body shell below the main shell body and to which the main shell body is pivoted, a rotary cutting knife rotatably supported in the bottom body shell; an annular tube inside the main shell body the annular tube comprises four arc-shaped tube plates which are placed so as to together define the annular tube, and the annular tube having a central X-shaped fixing axis radially inside the annular tube; the outer diameter of the tube defined by the four tube plates is slightly smaller than a diameter of a center hole inside a roll of tape to be placed on the tube; the fixing axis having legs which define four concave portions equally spaced around the fixing axis and projecting from the main shell body above the main shell body, the four concave portions being in two pairs, with alternate concave portions being paired; radially outward of the first pair of concave portions are respective first ones of the arc-shaped tube plates of a first height above the main shell body; the first tube plates are of a material to provide an outward expansion force; the tops of the first tube plates above the main shell body are provided with respective first flanges which extend radially outwardly from the fixing axis and which are at said first height above the main shell body that is selected to be used to fit-on a greater width tape; radially outward of the second of the pairs of concave portions are respective second ones of the arc-shaped tube plates which are of a second height above the main shell body shorter than said first height and also are of a material to provide an outward expansion force; the tops of the second tube plates above the main shell body are provided with respect second flanges, which extend radially outwardly from the fixing axis and which are at said second height above the main shell body that is selected to be used to fit on a narrower width tape.

2. An automatic tape cutter/sticker according to claim 1 wherein the cutting knife comprises a blade holder at the bottom body shell and the blade holder is rotatable in the shell body, the knife includes a cutting blade disposed in the blade holder and replaceably held therein.

3. An automatic tape cutter/sticker, comprising;

a first shell body having a rear wall;

first guide means in said rear wall for guiding motion of said first shell body;

a first pivot support for said first shell body on said rear wall, around which said first shell body is pivotably moveable;

an annular tube inside the first shell body, the annular tube comprises four arc-shaped tube plates which are placed so as to together define the annular tube, and the annular tube having a central X-shaped fixing axis radially inside the annular tube; the outer diameter of the tube defined by the four tube plates is slightly smaller than a diameter of a center hole inside a roll of tape to be placed on the tube; the fixing axis having legs which define four concave portions around the fixing axis; the four concave portions being in two pairs, with alternate concave portions being paired; radially outward of the first pair of concave portions are respective first ones of the arc-shaped tube plates of a first height above the main shell body; the first tube plates are of a material to provide an outward expansion force; the tops of the first tube plates above the main shell body are provided with respective first flanges which extend radially outwardly from the fixing axis and which are at said first height above the shell body that is selected to be used to fit-on a greater width tape; radially outward of the second of the pairs of concave portions are provided respect second ones of the arc-shaped tube plates which are of a second height above the main shell body shorter than said first height and also are of a material to provide an outward expansion force; the tops of the second tube plates above the main shell body are provided with respective second flanges, which extend radially outwardly from the fixing axis and which are at said second height above the main shell body that is selected to be used to fit on a narrower width tape;

a second shell body, shaped and sized for receiving at least partially within it said first shell body;

a second rear wall in said second shell body;

second guide means on said second rear wall positioned for cooperating with said first guide means in said first rear wall for providing pivoting motion of said first shell body with respect to said second shell body, said second rear wall including a second pivot support positioned to be in alignment with the first pivot support on the first rear wall, and the first and second pivot support being in engagement for enabling the first shell body to pivotally move with respect to and in the second shell body at the first and second cooperating pivot supports;

a tape outlet from said second shell body for permitting tape, or the like, which is supported on the fixing axis to exit from the tube and the first shell body into the second shell body and to exit from the tape outlet from the second shell body;

a rotary cutting knife disposed between the first and second shell bodies and between the first and second rear walls, the rotary cutting knife having a center of rotation defined on the second rear wall and having a blade holder extending outwardly from the second rear wall and eccentric to the center of rotation of the rotary cutting knife;

a cutting blade disposed in the eccentric blade holder such that upon rotation of the rotary cutting knife, the blade holder and blade are rotated for cutting;

spring means for biasing the first shell body to pivot in an upward direction with respect to the second shell body; and means on the first shell body for engaging the rotary cutting knife such that downward movement of the first shell body around the first and second pivot supports against the bias the spring means causes the means on the first shell body to engage the rotary cutting knife to rotate the cutting knife in a first direction which prepares the blade for cutting the tape, or the like, and such that return movement of the first shell body under the influence of the spring rotates the cutting knife to a position to cut the tape as the shell body is up-raised.

4. An automatic tape cutter/sticker according to claim 2 further comprising a tape roller ramming cylinder rotatably mounted at said first shell body, the tape roller ramming cylinder guiding the tape through the tape outlet.

* * * * *